US007017500B2

(12) United States Patent
Jones

(10) Patent No.: US 7,017,500 B2
(45) Date of Patent: Mar. 28, 2006

(54) MONITORING OF FUEL ON A GRATE FIRED BOILER

(75) Inventor: Andrew Jones, Cincinnati, OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/812,801

(22) Filed: Mar. 30, 2004

(65) Prior Publication Data

US 2005/0217544 A1 Oct. 6, 2005

(51) Int. Cl.
*F23K 3/00* (2006.01)
*F23N 5/18* (2006.01)
*F23B 7/00* (2006.01)

(52) U.S. Cl. ..... 110/101 CC; 110/101 CF; 110/186; 110/341

(58) Field of Classification Search ..... 110/101 CC, 110/101 C, 101 CB, 101 CF, 152 B, 185, 110/186, 341, 234, 346, 103, 255, 259
See application file for complete search history.

(56) References Cited

U.S. PATENT DOCUMENTS

| | | | | |
|---|---|---|---|---|
| 4,339,998 | A * | 7/1982 | Finch | 110/186 |
| 4,430,963 | A * | 2/1984 | Finet | 122/449 |
| 4,621,583 | A * | 11/1986 | Kaski | 110/346 |
| 5,398,623 | A * | 3/1995 | Lautenschlager et al. | 110/346 |
| 5,606,924 | A * | 3/1997 | Martin et al. | 110/341 |
| 6,323,442 | B1 | 11/2001 | Jones | |

* cited by examiner

*Primary Examiner*—Kenneth Rinehart
(74) *Attorney, Agent, or Firm*—Matthew M. Eslami

(57) ABSTRACT

Method and apparatus for sensing the overall and/or distribution of fuel weight disposed on the top surface of the grate of a grate-fired device and adjusting the fuel infeed as a function of the flow rate of steam generated by the boiler. A plurality of weight sensors are disposed remote from the grate at selected locations associated with the support for the grate and which provide signals which are convertible to useful representations of the overall weight and/or the distribution of fuel weight over the top surface of the grate in real time and independent of the forward movement of the grate and associated changes in the weight of the fuel on the grate at a given time.

15 Claims, 5 Drawing Sheets

MONITORING OF FUEL ON A GRATE FIRED BOILER

CROSS-REFERENCE TO RELATED APPLICATIONS

Not Applicable

DEVELOPMENT

Not Applicable

FIELD OF INVENTION

This invention relates to the measurement and/or monitoring of fuel deposited on a grate fired boiler or like device.

BACKGROUND OF INVENTION

In grate fired boilers or like devices, fuel (solids) to be burned is fed onto a grate, at times along with combustion aids such as gas or oil. Herein the term "solids fuel" is at times referred to as "fuel". The heat from the burning fuel is commonly used to generate steam. In the prior art, the rate of feeding of the fuel onto the grate has been manually controlled by an operator who uses visual observations, including use of cameras, and/or pyrometers as the tools for making judgment calls. It will be recognized that each of these methods of monitoring the progression of the burning of the fuel and the rate on incoming fuel to feed the combustion do not have the ability to provide a clear indication of the amount of material residing on the grate at any given time or over a period of time. Grates in boilers may comprise a continuous grate which is moved forwardly through the burner section of the boiler wherein the fuel is consumed and ash is generated. In this type boiler, the ash is carried out of the burner section and dumped into an ash bin by the moving grate. In other boilers, the grate may be mounted in place, but is vibrated to enhance combustion and to separate ash which falls through the grate into an ash bin. The present invention may be employed with either type grate, but is especially useful when employed with a forwardly moving grate.

Burning of fuel on a grate fired boiler is often limited due to the risk of excessive piling on of the fuel on the grate with an accompanying "over heating" or "under heating" of the water associated with the boiler, resulting in excessive production or insufficient production of steam output from the boiler or decrease in the efficiency of the burning process. This leads to lost opportunities to burn low cost solids fuels rather than higher cost oil or gas, for example. Oil or gas combustion enhancers can be used to relatively rapidly alter the heat generated in the burner section of the boiler, hence are convenient to use, but costly as concerns operational expense for the boiler. Since operator concern relating to excessive amounts of feed (and/or ash) material on the grate can limit the amount of material burned over a given time period and/or substantially decrease the permissible maximization of the feed of the fuel to the burner, a direct measurement of the weight of feed (and/or ash) on the grate is desirable so that lost opportunities to burn solids fuel can be eliminated and optimization of the burning process may be realized. It is projected that as much as a 10–20% incremental increase in the amount of solids fuel burned over a given period of time may be achieved if the fuel feed rate could be optimized.

SUMMARY OF INVENTION

In accordance with one aspect of the present invention, there is provided, real-time if desired, monitoring of the weight of the fuel deposited and residing on the grate of a grate fired boiler or like device employing, in one embodiment, a plurality of weight sensors, e.g., strain gages, load cells or combinations thereof, associated with the supporting structure for the grate, such weight sensors being located at strategic locations and in sufficient numbers, to detect the weight load on the grate at a plurality of locations over the area of the grate which bears the fuel during the burning process. These devices respond to strain or deflection (depending upon the type of sensor) of the grate support(s) to provide output signals which are indicative of the weight of the fuel disposed on the grate at each of the respective locations of the weight sensors. In accordance with one aspect of the present invention, the outputs from these devices are compared to the rate of actual flow of steam produced by the boiler at the time period during which the sensor signals are generated to provide either a visual indication to an operator or to provide infeed to a controller which automatically effects adjustment of the infeed rate of fuel to the grate, or both. In any event, the controller output is employed to adjust the desired rate of steam generation by the boiler through the means of adjusting the rate of infeed of solids fuel into the burner section of the boiler to thereby adjust the desired rate of steam generation by the boiler.

In accordance with a further aspect of the present invention, the weight sensors are positioned at locations where the grate (and its fuel load) is supported by superstructure. Notably, the weight sensors are disposed independent of the grate itself, hence their use in the present invention is applicable to either vibrated grates or forwardly moving grates. In the present disclosure, for reasons of clarity and other reasons, the description is directed principally toward a forwardly moving grate system.

In one embodiment, the weight of the fuel load at the fuel-receiving end of the grate and at the discharge end of the grate, at least, is sensed. Further, weight sensors preferably are located at spaced apart locations across the width of the grate, at locations intermediate the opposite ends of the top run of the grate. Through this means, there is obtainable a two-dimension map of the distribution of the fuel over substantially the entire fuel-supporting surface of the grate. Employing multiple fuel infeed sources, along with the two-dimensional map, permits the operator or automatic controller to select which particular one or ones of the multiple infeed sources should be selectively adjusted with respect to its contribution to the infeed of fuel onto the grate.

DETAILED DESCRIPTION OF THE INVENTION

Figure 1:
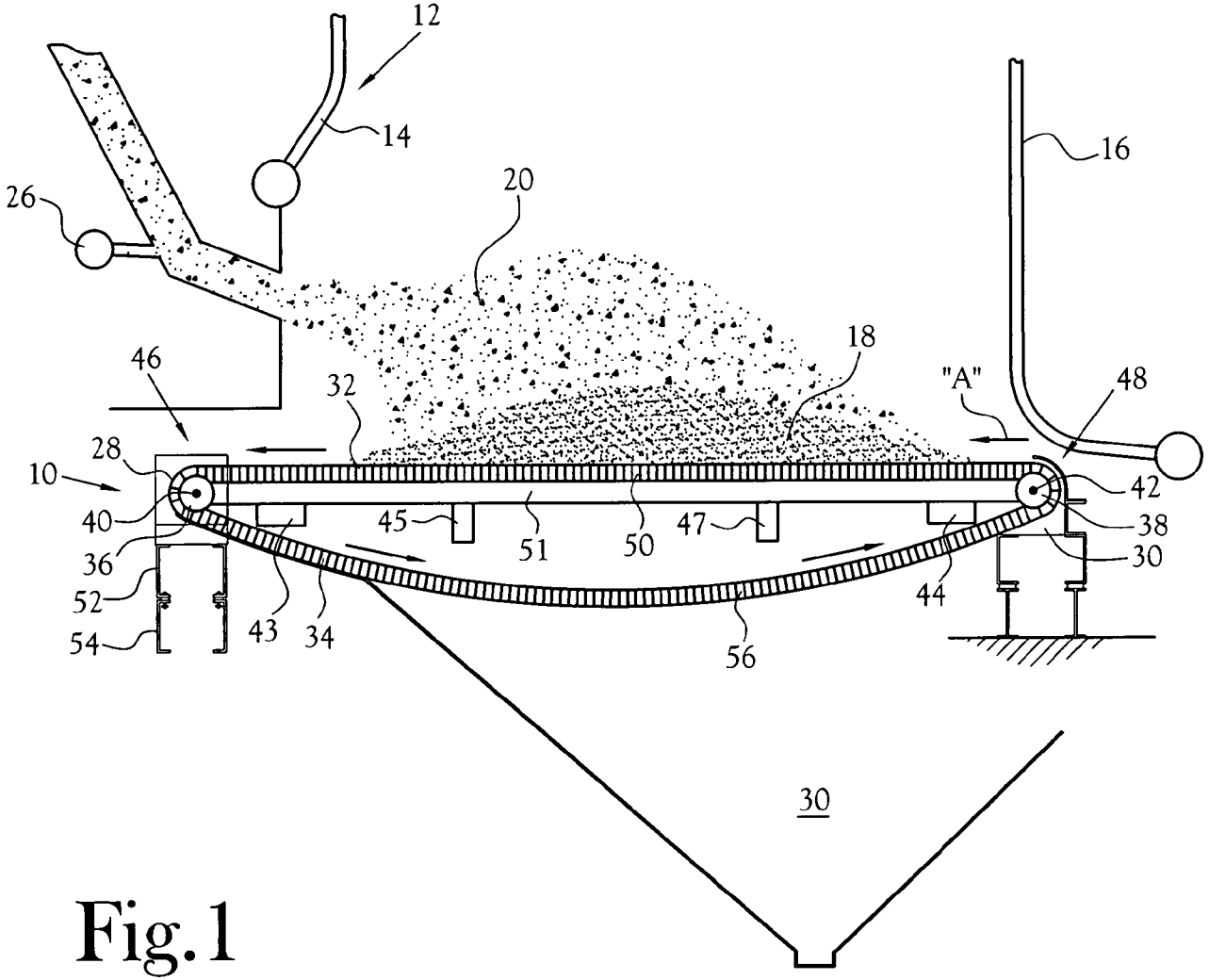
FIG. 1 is a schematic side elevation view of the bottom end of a typical moving-grate fired boiler to which there has been applied various aspects of the present invention.

With reference to the several Figures, in the depicted embodiment of the present invention, there is depicted a schematic side elevation view of the bottom end 10 of a typical grate fired boiler 12. The depicted boiler includes water-filled side walls 14 and 16 disposed above and surrounding a burning mass 18 of particulate solids fuel 20. The heat from the burning fuel functions to heat the water in the side walls to either a selected temperature, most commonly, to convert the water into steam which desirably flows from the boiler at a target rate of flow. The target rate of flow is commonly set as a function of the demand for steam at some location or locations remote from the boiler. The burner is fired by fuel which includes particulate solids 20 blown onto the grate as by a blower or multiple blowers and, as needed or desired, oil or gas. Control over the rate of solids fuel admitted to the burner, and/or the type of fuel admitted, is controlled by one or more valves or like flow control devices, such as solenoid controlled valves, all being well known in the art.

In the depicted boiler, the grate 32 comprises a continuous mesh 34 which is trained about first and second sprockets 36, 38, respectively (see FIG. 1), which are mounted on respective shafts 40, 42. Each shaft is journaled at its opposite ends on an end cross member 28. At the opposite end of the grate the mesh is trained about third 38 and fourth (not shown) sprockets mounted on a shaft 42 which is journaled on an end support member 30 and one each of which is located proximate a respective end 41,43 of the top run 50 of the grate (see FIG. 2). These end support beams, in turn, are mounted on and supported by first and second sets 80, 110 of substantially parallel and mirror image "C" grate support beams.

The top run 50 of the forwardly moving grate is supported for movement by a plurality of aligned channel members 51 (typical) (see FIG. 2) which collectively provide support for the top run 50 of the grate thereover. These channel members, four such channel members being depicted schematically in FIG. 2, extend from the first end 46 of the top run of the grate to the second end 48 of the top run of the grate. These channel members are supported at their respective ends by the end support members 28 and 30, respectively. Further support for the top run of the grate is provided by cross support beams 56 and 58, for example, intermediate the opposite ends of the top run of the grate to aid in supporting the channel members, hence the top run of the grate.

The return run 56 of the grate passes through an ash bin 30 to deposit ash from the burner into the bin. Power for driving the moving grate may be provided by any conventional motor and/or gear train, (not shown) acting through one of the sprockets, 36 for example. Most commonly, the rate of forward travel of the grate is held constant, but can be adjusted as needed or desired.

In accordance with one aspect of the present invention, at locations adjacent the opposite ends 46, 48 of the top run 50 of the grate 32 and at locations intermediate the opposite ends of the top run of the grate, there are provided weight sensors, such as load cells and/or strain gages which are distributed such that weight sensing of the fuel load 58 on the grate is available over substantially the full area of the grate.

Figure 2:
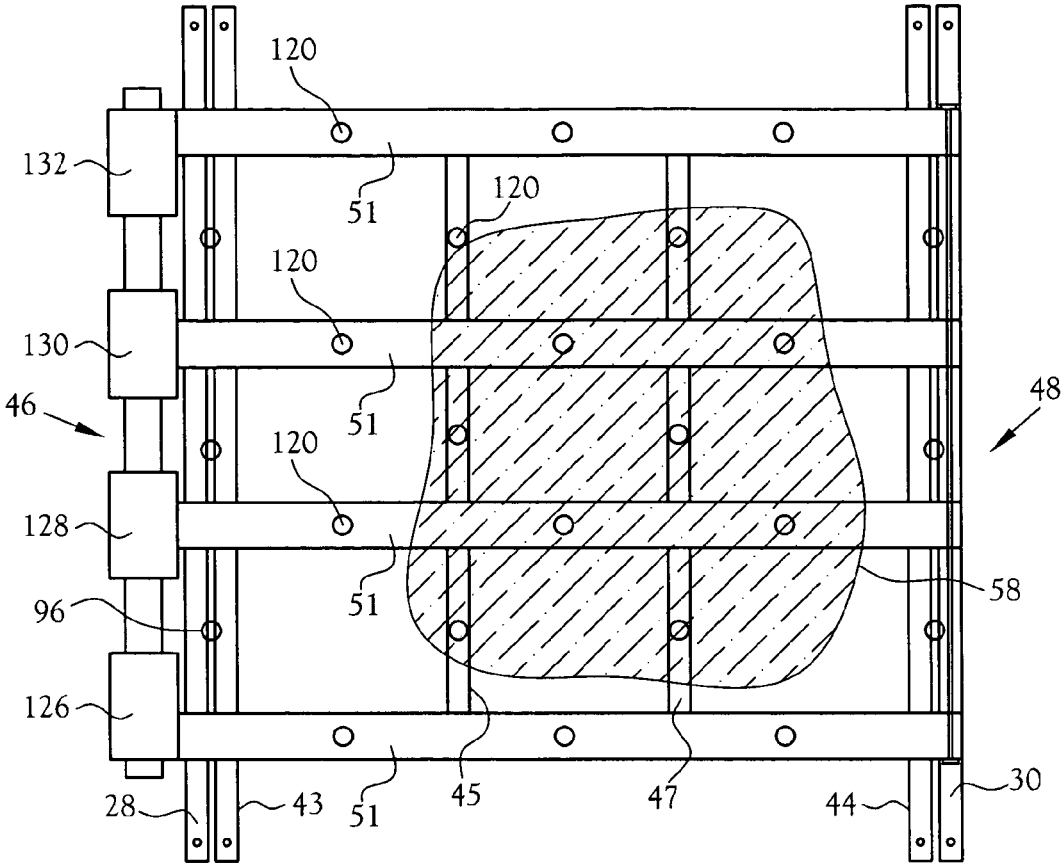
FIG. 2 is a schematic representation of a top view of the central portion of the grate depicted in FIG. 1 and showing desirable locations of strain gages and/or load cells.
Figure 3:
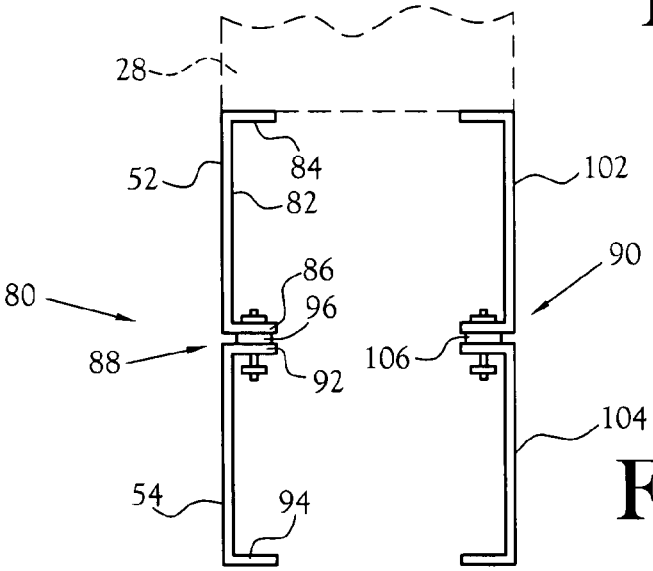
FIG. 3 is an enlarged schematic side elevation view of a portion of the support beams for the left hand end of the apparatus depicted in FIG. 1.
Figure 4:
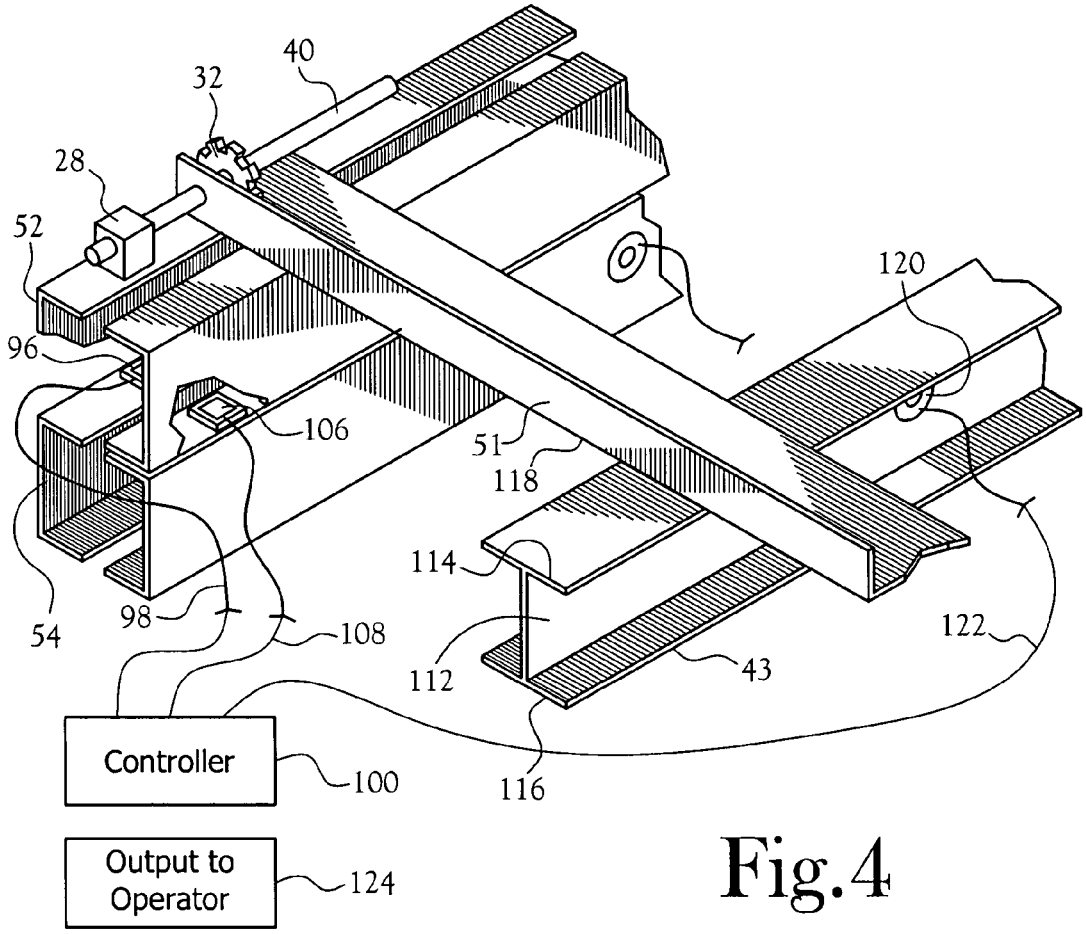
FIG. 4 is a schematic representation of a corner portion of the device depicted in FIG. 1 and depicting various elements of the support for the moving grate and the placement of weight sensors thereon.

Specifically, and referring to FIGS. 1–3 in the depicted embodiment, each end 46, 48 of the top run 50 of the grate is supported by, among other members such as support member 28, a first set 80 of stacked "C" beams. Each beam (beam 52 for example) includes a central web 82 and top and bottom lateral flanges 84 and 86, respectively. Each set 80 includes first and second stacks 88, 90 of "C" beams, the stacks being disposed contiguous to, and aligned with, one another and extending between the opposite sides of the grate. The first stack of beams 88 comprises upper beam 52 and bottom beam 54, one disposed on top of the other with the bottom flange 86 of the upper beam 52 disposed above and in alignment with the top flange 92 of the bottom beam 54 such that these respective bottom and top flanges of this stack overlie one another. In accordance with the present invention, a load cell 96 is interposed between the overlying flanges 86, 92 of the beams of the first stack 88 of beams and includes an electrical lead 98 (FIG. 4) extending therefrom to a controller 100. The second stack 90 of two beams 102, 104 is a mirror image of the first stack such that the lateral flanges of the beams of the first stack and the lateral flanges of the beams of the second stack face one another as seen in FIG. 3. As in the first stack, a load cell 106 is interposed between the overlying flanges of the beams 102, 104 of the second stack of beams and includes an electrical lead 108 extending therefrom to the controller 100.

The opposite end 48 of the top run of the grate is likewise supported by a second set 110 of stacked "C" beams, this second set being substantially identical in configuration to the first set 80 of stacked beams described hereinabove. This second set of stacked beams also includes load cells (not shown) positioned like the load cells associated with the first set of stacked beams and includes respective electrical leads (not shown) extending from each load cell to the controller. As thus configured, there is a load cell disposed at each of the four corners of a top run of a grate of rectangular geometry for determination of the total overall weight of fuel disposed on the grate.

As noted hereinabove, the grate is slidingly supported by a plurality of channel members 51 which are in turn supported at their respective opposite ends on the first and second sets 80 and 110 of stacked beams. Intermediate the opposite ends of the top run of the grate, in the depicted embodiment there are provided one or more cross beams 43, 44, 45 and 47, such as "I" beams, which extend generally perpendicular to the channel members and are positioned beneath the channel members to provide support for such channel members and the grate disposed on the channel members. Preferably and as depicted in FIG. 2, there is a plurality of these cross beams which are spaced apart from one another to provide support for the channel members and the grate at multiple locations between the ends of the top run of the grate. In the depicted embodiment (see FIG. 4) of the present invention, each of these cross beams, 43 for example, includes a central web 112 and top and bottom flanges 114, 116, respectively. As depicted, the central web is disposed vertically with its top flange 114 in supporting engagement with the bottom surface 118 of the several channel members. As so positioned, each web is subject to flexing as a function of the weight of the fuel load on the grate. To sense the flexing, hence the fuel load weight at various locations along the length of each of the cross beams, strain gages 120 are affixed to the web of each cross beam at spaced apart locations along the length of the cross beam, thereby providing for sensing of the weight of the fuel load on the grate in the immediate vicinity of each strain gage. Each strain gage includes an electrical lead 122 extending from the strain gage to the controller 100.

It will be recognized that the weight of the fuel load 58 disposed on the grate of the boiler will be ever changing over time as fuel is consumed and new fuel is added. The rate of steam generation by the boiler is a function of the burn rate of the fuel. Contrary to certain practices, addition of fuel to the grate does not result in faster generation of steam. Rather, it is the rate of burn of the fuel which controls the generation of the steam. Moreover, knowledge of the burn rate of the fuel over some limited area of the fuel load on the grate is ineffective as a guide to adjusting the rate of steam production via control of the addition of fuel to the grate. The present inventors have found that a determination of the overall fuel loading on the grate can be employed as a valid indicator of the rate of steam production by the boiler. To this end, the present invention provides multiple locations over substantially the entire area of the grate wherein the weight of the fuel load on the grate is determined over time, thereby developing a two-dimensional representation of the fuel load change over time. This information provides an operator with sufficient information for adjusting, if necessary, the fuel load on the grate as a function of the burn rate of the fuel. Adjustment of the the fuel load may be enhanced by employing multiple laterally spaced apart inlets for feeding fuel onto the grate.

Thus, in accordance with the present invention, the present inventors have chosen to sense the overall weight of the fuel load on the grate as by load cells located at the opposite ends of the top run of the grate, and by sensing distortion of grate-supporting beams located intermediate the opposite ends of the top run of the grate, employing strain gages affixed to the webs of these support beams. This latter arrangement of strain gages provides for sensing the fuel load on the grate in the area immediate each strain gage at a given time. These weight sensing measures provide the operator with information relative to the overall load of fuel on the grate and the load of fuel on various areas of the grate, all such information being obtained dynamically as the grate moves forwardly in the direction indicated by the arrow "A" in FIG. 1. Accordingly, the operator is provided with information concerning the rate of fuel burn at substantially any location or series of locations on the grate, such that fuel feed to any given area of the grate may be adjusted as needed to alter the contribution of the burning fuel at any such location on the grate as may be in order for optimum utilization of the fuel and the desired rate of steam production by the boiler.

As noted, each strain gage generates an electrical signal which is a function of the sensed deformation of a respective cross support beam in the vicinity of the strain gage and the load cells generate electrical signals which are a function of the overall fuel load associated with each of the opposite ends of the top run of the grate. Each signal from each strain gage and each load cell is transmitted as by electrical conduits to the controller 100. Within the controller, each signal is compensated for temperature, amplified and/or otherwise modulated as needed or desired, to develop an output 124 signal from the controller which is representative of the weight of the fuel detected by a given strain gage. This output signal from the controller may be only a visual representation of the weight of fuel on the grate, e.g., a two dimensional map format, or other visualization of the total weight or weight distribution of fuel on the grate, or other like visualization from which an operator may adjust the infeed of fuel to the burner. If desired, the output signal from the controller may be employed to automatically adjust valving associated with the infeed of fuel to the burner as will be recognized by one skilled in the art. A suitable strain gage will be recognized by one skilled in the art.

Similar to the strain gages, the present invention comprehends the use of other devices for identifying the weight of fuel disposed on the grate. These other devices may be in lieu of, but preferably are in addition to, the use of strain gages or load cells.

As noted, the weight monitoring apparatus is operable dynamically in that the weight monitoring is performed on a real-time basis as the grate is moving forwardly with its load of fuel which is being consumed, hence depleted and with accompanying weight change, as the grate moves through the burner. This feature of the invention is made possible by performing the weight monitoring at locations associated with the support structure for the grate, not at locations on the grate itself. This "indirect" weight monitoring feature is thus functionally independent of the motion of the grate, but remains representative of the ever-changing overall fuel weight and the distribution of fuel weight over substantially the entire fuel-bearing upper surface of the top run of the grate, even as the grate moves.

Further, through the provision of independently operable and adjustable multiple infeeds 126–132 (FIG. 2) for feeding fuel onto the grate, the present invention permits distribution of the infed fuel onto the grate at selected locations across the width of the grate to thereby adjust the quantity, hence weight, of fuel deposited on the grate as a function of the detected lateral distribution of fuel weight across the width of the grate (width being measured perpendicular to the direction of forward travel of the grate).

Figure 5:
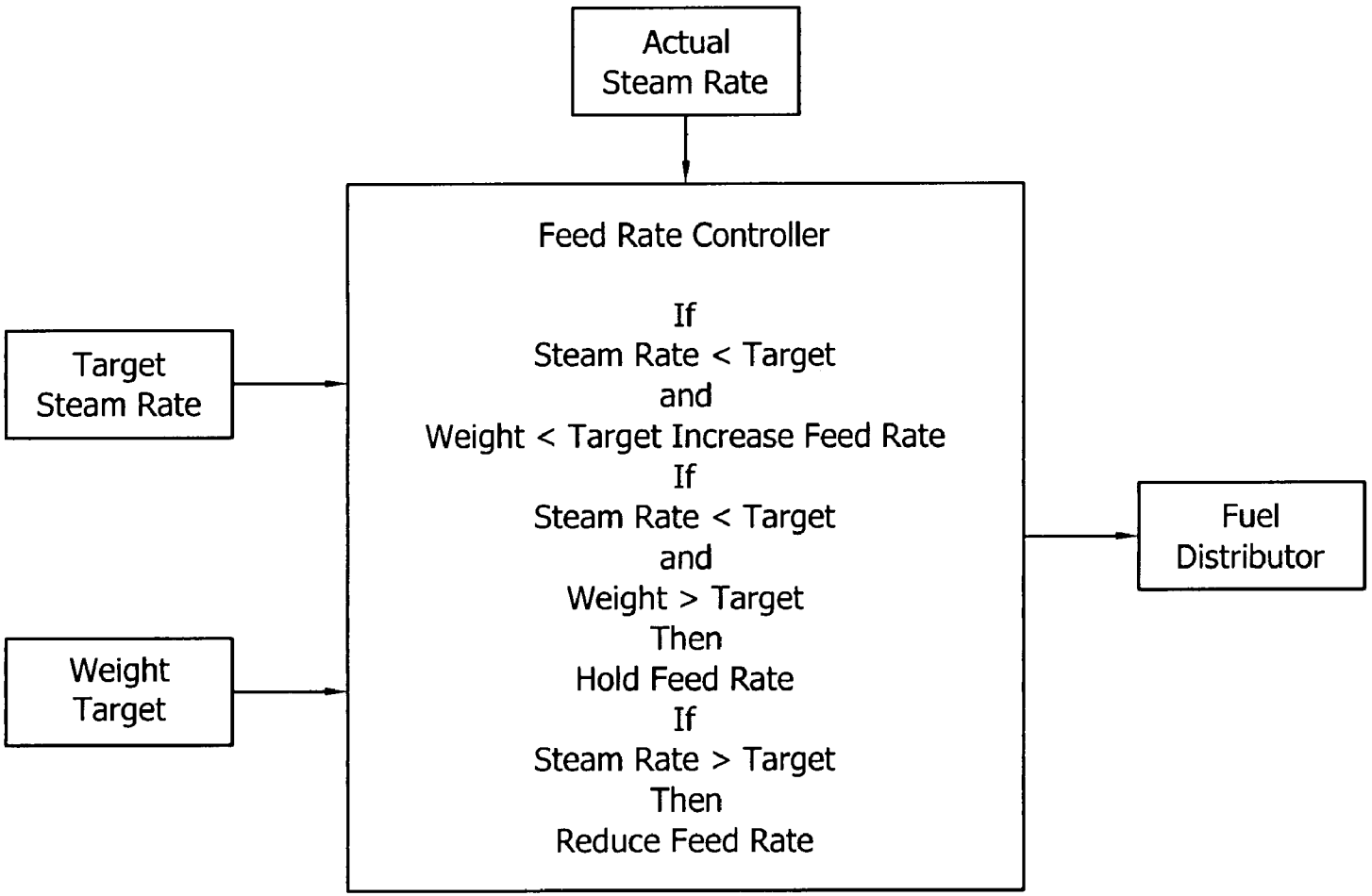
FIG. 5 is a schematic flow diagram of one embodiment of the operation of a typical steam-generating boiler employing various aspects of the present invention.

Referring to FIG. 5, in accordance with one typical operation of the present invention, in a moving-grate fired boiler, there is set a target steam generation rate and a target feed rate, each of which is fed to a controller. In similar manner, the weight indication(s) from the weight sensors associated with the moving grate are also fed to the controller. Further, a signal representative of the actual steam rate flowing from the boiler is fed to the controller.

Within the controller, employing the aforesaid actual steam generation flow rate, the target steam rate, the target feed rate and and the weight sensor(s) input signals, the actual steam rate signal is compared to the target steam rate signal and the target feed rate signal. If the signal comparison shows that the actual steam rate is less than the target steam rate and the sensed weight is less than the target weight, a signal is generated to increase the feed rate. If the signal comparison shows that the actual steam flow rate is less than the target steam rate and the sensed weight is greater than the target feed rate, then no change is made in the existing feed rate. If the signal comparison shows that the actual steam flow rate is greater than the target steam flow rate, then a signal is fed to the fuel infeed apparatus to reduce the feed rate.

Figure 6:
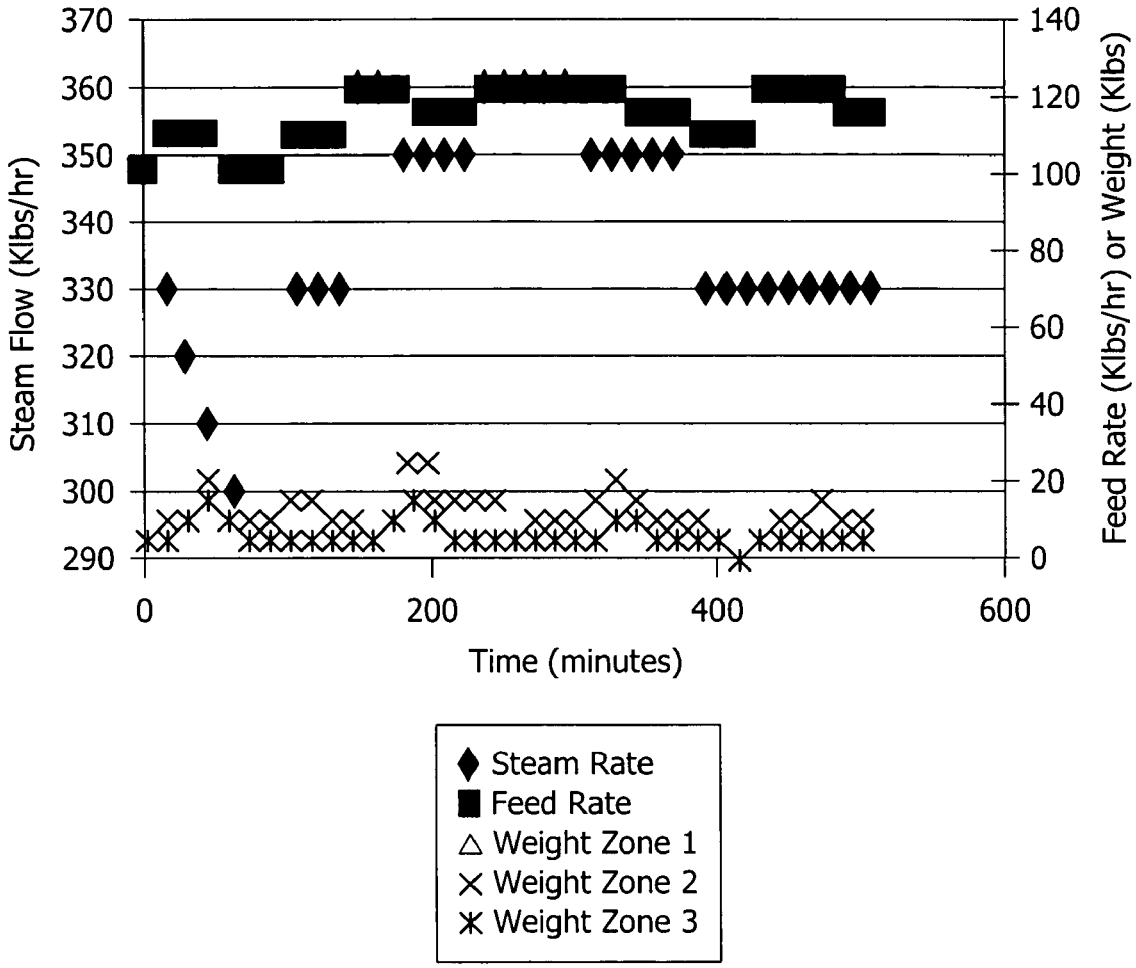
FIG. 6 is a graph depicting control over the actual steam output from a boiler versus the weight of fuel fed to the burner section of the boiler over time in accordance with the present invention.

FIG. 6 depicts graphically the steam flow rate in a typical operation of a moving-grate fired boiler generating steam as a function of the fuel infeed rate over time. In this graph, the grate is divided into three sections, i.e., an infeed section, a central section, and a discharge section. Notably, employing the concepts of the present invention, there is relatively close direct correlation of the fuel infeed rate and the actual steam output flow rate, with good even distribution of the fuel over the three sections of the grate, a desired situation for optimumization of the fuel consumption.

Whereas the present invention has been described in specific terms and employing specific load-bearing detectors, it will be recognized by one skilled in the art that other similarly functioning load detectors may be employed. It is therefore intended that the invention be limited only as set forth in the claims appended hereto.

What is claimed is:

1. Apparatus for monitoring the weight of the fuel load on the top run of a moving grate of a grate fired boiler having at least one fuel infeed and structural support members for the top run of the grate, the grate including opposite sides and a top surface for the receipt of fuel thereon comprising a plurality of weight sensors associated with the structural support members for the grate, said sensors being physically separated from the grate and spaced apart from one another at grate-supporting locations which provide a representative virtual two dimensional map of the weight distribution of fuel disposed on the top surface of the grate.

2. The apparatus of claim 1 wherein the virtual dimensional map is provided real time.

3. The apparatus of claim 1 wherein at least one or more of said plurality of weight sensors are disposed between abutting elements of the structural support members for opposite ends of the top run of the grate in position to sense the overall weight of the fuel load on the grate.

4. The apparatus of claim 3 wherein said structural support members include support members or the grate disposed intermediate the opposite ends of the top run of the grate and weight sensors affixed to said intermediate members at spaced apart locations over substantially the entire area of a fuel load disposed on the grate.

5. The apparatus of claim 1 wherein said weight sensors comprise strain gages, load cells or combinations thereof.

6. The apparatus of claim 1 wherein the structural support members for the grate include first and second sets of stacked elongated beams disposed adjacent respective opposite ends of the top run of the grate and extending laterally across the width of the grate, and wherein said weight sensors are disposed between said first and second elongated beams of each set of stacked beams.

7. The apparatus of claim 1 wherein each of said plurality of weight sensors produces an output signal which is convertible to a visual or other representation of the weight of fuel disposed on the grate in the vicinity of said weight sensor.

8. A method for monitoring the weight of fuel disposed on the top surface of the top run of a grate moving forwardly through the burner of a grate-fired boiler, the grate being supported for movement through the burner by at least first and second support members, comprising the steps of disposing a plurality of weight sensors in association with each of the at least first and second support members, said weight sensors being located at spaced apart locations along said support members, remotely from the grate, each of said weight sensors generating a real-time signal which is representative of the weight of fuel disposed on the grate adjacent the location of said weight sensor at any given point in time, employing said signal from each of said plurality of weight sensors to provide a visual or other real-time representation of the overall weight or distribution of weight of fuel disposed on the grate at any given time; and collecting and modulating the output signals from each of said plurality of weight sensors and producing a two-dimensional map of the distribution of weight of the fuel load over the top run of the grate.

9. The method of claim 8 wherein said plurality of weight sensors comprises strain gages or load cells or combinations thereof.

10. The method of claim 8 and including the step of collecting and modulating the output signals from each of said plurality of weight sensors and producing a further signal suitable for controlling one or more infeeds of fuel onto the grate as a function of the sensed distribution of fuel weight over the top surface of the grate.

11. The method of claim 8 wherein said signal from each of said plurality of weight sensors is generated real time.

12. The method of claim 8 and including the steps of generating steam employing the heat from the burning of the fuel disposed on said grate, and adjusting the weight of fuel on said grate as a function of the amount of steam generated.

13. The method of claim 12 wherein the amount of steam generated is measured by the flow rate of steam emanating from the boiler.

14. A method for monitoring the weight of fuel disposed on the top surface of the top run of a grate moving forwardly through the burner of a grate-fired boiler, the grate being supported for movement through the burner by at least first and second support members, comprising the steps of disposing a plurality of weight sensors in association with each of the at least first and second support members, said weight sensors being located at spaced apart locations along said support members, remotely from the grate, each of said weight sensors generating a real-time signal which is representative of the weight of fuel disposed on the grate adjacent the location of said weight sensor at any given point in time;

employing said signal from each of said plurality of weight sensors to provide a visual or other real-time representation of the overall weight or distribution of weight of fuel disposed on the grate at any given time; and generating steam employing the heat from the burning of the fuel disposed on said grate, and adjusting the weight of fuel on said grate as a function of the amount of steam generated.

15. The method of claim 14 wherein the amount of steam generated is measured by the flow rate of steam emanating from the boiler.

* * * * *